US009453395B2

(12) United States Patent
Fripp et al.

(10) Patent No.: US 9,453,395 B2
(45) Date of Patent: Sep. 27, 2016

(54) AUTONOMOUS FLUID CONTROL ASSEMBLY HAVING A MOVABLE, DENSITY-DRIVEN DIVERTER FOR DIRECTING FLUID FLOW IN A FLUID CONTROL SYSTEM

(71) Applicant: HALLIBURTON ENERGY SERVICES, INC., Houston, TX (US)

(72) Inventors: Michael L Fripp, Carrollton, TX (US); Jason Dykstra, Carrollton, TX (US); Orlando DeJesus, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 263 days.

(21) Appl. No.: 14/043,291

(22) Filed: Oct. 1, 2013

(65) Prior Publication Data

US 2014/0041731 A1 Feb. 13, 2014

Related U.S. Application Data

(63) Continuation of application No. PCT/US2011/060331, filed on Oct. 11, 2011.

(60) Provisional application No. 61/473,700, filed on Apr. 8, 2011.

(51) Int. Cl.
*E21B 43/12* (2006.01)
*E21B 34/08* (2006.01)
(Continued)

(52) U.S. Cl.
CPC ..... *E21B 43/12* (2013.01); *E21B 34/08* (2013.01); *E21B 34/06* (2013.01); *E21B 43/08* (2013.01);
(Continued)

(58) Field of Classification Search
CPC ..... E21B 43/12; E21B 43/08; E21B 43/14; E21B 43/32; E21B 34/08; E21B 34/06; E21B 33/12; Y10T 137/2087; Y10T 137/0391; F15C 1/16
USPC ..... 137/808, 812, 813, 834, 836, 467.5
See application file for complete search history.

(56) References Cited

U.S. PATENT DOCUMENTS 3,209,774 A * 10/1965 Manion ..... F15C 1/16 116/137 A
3,363,642 A * 1/1968 Grayson ..... C02F 1/686 137/399
(Continued)

FOREIGN PATENT DOCUMENTS

CN 102235162 A 11/2011
WO WO 2011/097101 A1 8/2011
WO WO 2013/066291 A1 5/2013

OTHER PUBLICATIONS

European Extended Search Report, Nov. 24, 2015, EP 11875466, 8 pages.
(Continued)

*Primary Examiner* — Craig Schneider
*Assistant Examiner* — Josephine Trinidad-Borges

(57) ABSTRACT

An apparatus is presented for autonomously controlling fluid flow in a subterranean well, the fluid having a density which changes over time. An embodiment of the apparatus has a vortex chamber, a vortex outlet, and first and second inlets into the vortex chamber. Flow into the inlets is directed by a fluid control system which has a control passageway for directing fluid flow as it exits a primary passageway. A movable fluid diverter positioned in the control passageway moves in response to change in fluid density to restrict fluid flow through the control passageway. When fluid flow through the control passageway is unrestricted, fluid from the control passageway directs fluid exiting the primary passageway toward a selected vortex inlet. When flow through the control passageway is unrestricted, flow from the primary passageway is directed into the other vortex inlet.

21 Claims, 6 Drawing Sheets

(51) Int. Cl.

| | |
|---|---|
| *F15C 1/16* | (2006.01) |
| *E21B 34/06* | (2006.01) |
| *E21B 43/08* | (2006.01) |
| *E21B 43/14* | (2006.01) |
| *E21B 43/32* | (2006.01) |

(52) U.S. Cl.

CPC ..... *E21B 43/14* (2013.01); *E21B 43/32* (2013.01); *F15C 1/16* (2013.01); *Y10T 137/0391* (2015.04); *Y10T 137/2087* (2015.04)

(56) References Cited

U.S. PATENT DOCUMENTS

| | | | | | |
|---|---|---|---|---|---|
| 3,486,517 | A * | 12/1969 | Gaura | F15C 1/08 | 137/832 |
| 3,754,576 | A * | 8/1973 | Zetterstrom | F15C 1/14 | 137/829 |
| 4,167,873 | A * | 9/1979 | Bahrton | F15C 1/22 | 137/835 |
| 4,276,943 | A * | 7/1981 | Holmes | E21B 47/18 | 137/810 |
| 4,579,139 | A * | 4/1986 | Stouffer | F04F 10/00 | 137/142 |
| 5,003,352 | A * | 3/1991 | Duchesne | G03G 15/105 | 101/366 |
| 8,708,050 | B2 * | 4/2014 | Dykstra | E21B 43/12 | 166/250.15 |
| 2007/0227536 | A1 * | 10/2007 | Rivera | A61M 11/06 | 128/200.21 |
| 2008/0041580 | A1 | 2/2008 | Freyer et al. | | |
| 2011/0042091 | A1 | 2/2011 | Dykstra et al. | | |
| 2011/0042092 | A1 | 2/2011 | Fripp et al. | | |
| 2011/0186300 | A1 | 8/2011 | Dykstra et al. | | |
| 2011/0266001 | A1 | 11/2011 | Dykstra et al. | | |

OTHER PUBLICATIONS

International Search Report, Aug. 31, 2012, PCT/US2011/060331, 4 pages.

Chinese Office Action dated Nov. 2, 2015 for Chinese Patent Application No. 201180069624.3, 11 pages.

* cited by examiner

AUTONOMOUS FLUID CONTROL ASSEMBLY HAVING A MOVABLE, DENSITY-DRIVEN DIVERTER FOR DIRECTING FLUID FLOW IN A FLUID CONTROL SYSTEM

CROSS-REFERENCE TO RELATED APPLICATIONS

This application is continuation of PCT International Application No. PCT/US2011/060331, filed on Nov. 11, 2011, which claims benefit of U.S. Provisional Application Ser. No. 61/473,730, filed on Apr. 8, 2011. Each patent application identified above is herein incorporated in its entirety by reference for all purposes.

FIELD OF INVENTION

The invention relates to apparatus and methods for autonomously controlling fluid flow through a system using a density-driven diverter, which moves in response to fluid density change, to restrict flow through a fluid control passageway in a flow control assembly.

BACKGROUND OF INVENTION

During the completion of a well that traverses a hydrocarbon bearing subterranean formation, production tubing and various equipment are installed in the well to enable safe and efficient production of the fluids. For example, to prevent the production of particulate material from an unconsolidated or loosely consolidated subterranean formation, certain completions include one or more sand control screens positioned proximate the desired production intervals. In other completions, to control the flow rate of production fluids into the production tubing, it is common practice to install one or more inflow control devices with the completion string.

Production from any given production tubing section can often have multiple fluid components, such as natural gas, oil and water, with the production fluid changing in proportional composition over time. Thereby, as the proportion of fluid components changes, the fluid flow characteristics will likewise change. For example, when the production fluid has a proportionately higher amount of natural gas, the viscosity of the fluid will be lower and density of the fluid will be lower than when the fluid has a proportionately higher amount of oil. It is often desirable to reduce or prevent the production of one constituent in favor of another. For example, in an oil-producing well, it may be desired to reduce or eliminate natural gas production and to maximize oil production. While various downhole tools have been utilized for controlling the flow of fluids based on their desirability, a need has arisen for a flow control system for controlling the inflow of fluids that is reliable in a variety of flow conditions. Further, a need has arisen for a flow control system that operates autonomously, that is, in response to changing conditions downhole and without requiring signals from the surface by the operator. Further, a need has arisen for a flow control system without moving mechanical parts which are subject to breakdown in adverse well conditions including from the erosive or clogging effects of sand in the fluid. Similar issues arise with regard to injection situations, with flow of fluids going into instead of out of the formation.

SUMMARY OF THE INVENTION

The invention relates to apparatus and methods for autonomously controlling fluid flow by using a movable, density-driven, diverter in one or more fluid control passageways in a fluid control assembly. An apparatus is presented for autonomously controlling fluid flow in a subterranean well, the fluid having a density which changes over time. An embodiment of the apparatus has a vortex chamber, a vortex outlet, and first and second flow inlets into the vortex chamber. Flow into the inlets is directed by a fluid control system which has a first and second passageway, the second passageway for controlling fluid flow as it exits the first passageway. A movable fluid diverter positioned in the second passageway moves in response to change in fluid density to restrict fluid flow through the second passageway. When fluid flow through the second passageway is unrestricted, the fluid impinges upon or directs fluid flow exiting the first passageway into a selected inlet of the vortex chamber. When flow is restricted in the second passageway, the flow exiting the first passageway is directed in to an alternate inlet in the vortex assembly.

Thus, changes in fluid density autonomously operate the density-driven diverter, which alternately restricts and allows flow through the second passageway. In turn, fluid flow from the second passageway directs the flow from the first passageway into the vortex to create substantially centrifugal flow, wherein flow across the vortex assembly is restricted, or substantially radial flow, wherein flow across the vortex assembly is relatively unrestricted. Consequently, a desired fluid, such as oil, can be selected for relatively free flow through the apparatus while an undesired fluid of a different density, such as water, can be relatively restricted.

Several embodiments of a fluid diverter are presented. The movable fluid diverter can rotate about its longitudinal axis, radial axis, float and sink in a chamber positioned in or along the passageway, etc. The movable diverter is of a preselected effective density and is buoyant in a fluid of a preselected density. The fluid diverter can be biased towards a position by a biasing member to achieve a desired effective density.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear. Upstream and downstream are used to indicate location or direction in relation to the surface, where upstream indicates relative position or movement towards the surface along the wellbore and downstream indicates relative position or movement further away from the surface along the wellbore.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention.

Figure 1:
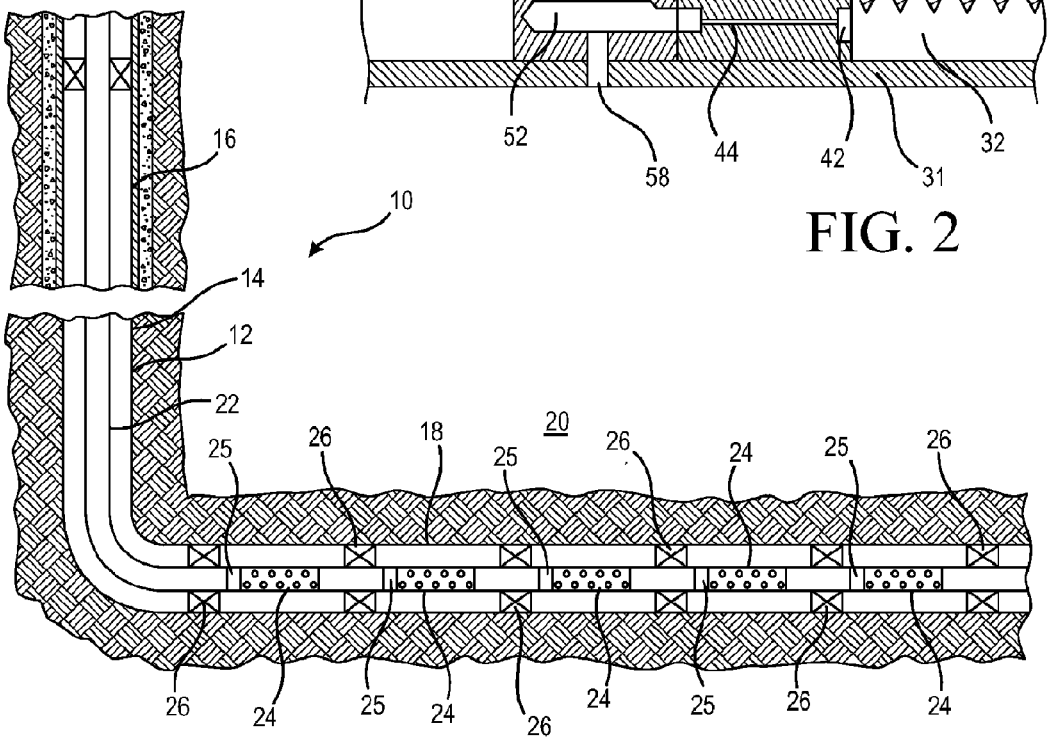
FIG. 1 is a schematic illustration of a well system including a plurality of autonomous fluid flow control systems according to an embodiment of the invention.

FIG. 1 is a schematic illustration of a well system, indicated generally 10, including a plurality of autonomous flow control systems embodying principles of the present invention. A wellbore 12 extends through various earth strata. Wellbore 12 has a substantially vertical section 14, the upper portion of which has installed therein a casing string 16. Wellbore 12 also has a substantially deviated section 18, shown as horizontal, which extends through a hydrocarbon-bearing subterranean formation 20. As illustrated, substantially horizontal section 18 of wellbore 12 is open hole. While shown here in an open hole, horizontal section of a wellbore, the invention will work in any orientation, and in open or cased hole. The invention will also work equally well with injection systems.

Positioned within wellbore 12 and extending from the surface is a tubing string 22. Tubing string 22 provides a conduit for fluids to travel from formation 20 upstream to the surface. Positioned within tubing string 22 in the various production intervals adjacent to formation 20 are a plurality of autonomous fluid control systems 25 and a plurality of production tubing sections 24. At either end of each production tubing section 24 is a packer 26 that provides a fluid seal between tubing string 22 and the wall of wellbore 12. The space in-between each pair of adjacent packers 26 defines a production interval.

In the illustrated embodiment, each of the production tubing sections 24 includes sand control capability. Sand control screen elements or filter media associated with production tubing sections 24 are designed to allow fluids to flow therethrough but prevent particulate matter of sufficient size from flowing therethrough. While the invention does not need to have a sand control screen associated with it, if one is used, then the exact design of the screen element associated with fluid flow control systems is not critical to the present invention. There are many designs for sand control screens that are well known in the industry, and will not be discussed here in detail. Also, a protective outer shroud having a plurality of perforations therethrough may be positioned around the exterior of any such filter medium. Through use of the fluid control systems 25 of the present invention in one or more production intervals, some control over the volume and composition of the produced fluids is enabled. For example, in an oil production operation if an undesired fluid component, such as water, steam, carbon dioxide, or natural gas, is entering one of the production intervals, the flow control system in that interval will autonomously restrict or resist production of fluid from that interval.

The term "natural gas" or "gas" as used herein means a mixture of hydrocarbons (and varying quantities of non-hydrocarbons) that exist in a gaseous phase at room temperature and pressure. The term does not indicate that the natural gas is in a gaseous phase at the downhole location of the inventive systems. Indeed, it is to be understood that the flow control system is for use in locations where the pressure and temperature are such that natural gas will be in a mostly liquefied state, though other components may be present and some components may be in a gaseous state. The inventive concept will work with liquids or gases or when both are present.

The fluid flowing into the production tubing section typically comprises more than one fluid component. Typical components are natural gas, oil, water, steam or carbon dioxide. Steam and carbon dioxide are commonly used as injection fluids to drive the hydrocarbon towards the production tubular, whereas natural gas, oil and water are typically found in situ in the formation. The proportion of these components in the fluid flowing into each production tubing section will vary over time and based on conditions within the formation and wellbore. Likewise, the composition of the fluid flowing into the various production tubing sections throughout the length of the entire production string can vary significantly from section to section. The flow control system is designed to reduce or restrict production from any particular interval when it has a higher proportion of an undesired component.

Accordingly, when a production interval corresponding to a particular one of the flow control systems produces a greater proportion of an undesired fluid component, the flow control system in that interval will restrict or resist production flow from that interval. Thus, the other production intervals which are producing a greater proportion of desired fluid component, in this case oil, will contribute more to the production stream entering tubing string 22. In particular, the flow rate from formation 20 to tubing string 22 will be less where the fluid must flow through a flow control system (rather than simply flowing into the tubing string). Stated another way, the fluid control system creates a flow restriction on the fluid.

Though FIG. 1 depicts one flow control system in each production interval, it should be understood that any number of systems of the present invention can be deployed within a production interval without departing from the principles of the present invention. Likewise, the inventive flow control systems do not have to be associated with every production interval. They may only be present in some of the production intervals in the wellbore or may be in the tubing passageway to address multiple production intervals.

Figure 2:
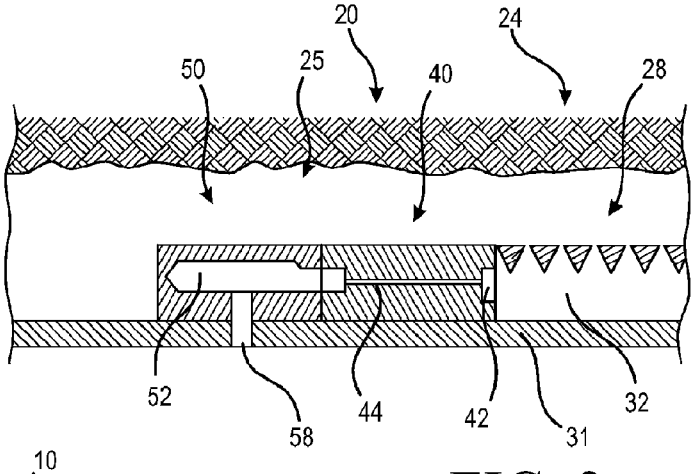
FIG. 2 is a side view in cross-section of a screen system and an embodiment of an autonomous fluid control system of the invention.

FIG. 2 is a side view in cross-section of a screen system 28, and an embodiment of an autonomous fluid control system 25 of the invention having a flow direction control system, including a flow ratio control system or fluid control assembly 40, and a pathway dependent resistance system or vortex assembly 50. The production tubing section 24 has a screen system 28, an optional inflow control device (not shown) and an autonomous fluid control system 25. The production tubular defines an interior passageway 32. Fluid flows from the formation 20 into the production tubing section 24 through screen system 28. The specifics of the screen system are not explained in detail here. Fluid, after being filtered by the screen system 28, if present, flows into the interior passageway 32 of the production tubing section 24. As used here, the interior passageway 32 of the production tubing section 24 can be an annular space, as shown, a central cylindrical space, or other arrangement.

In practice, downhole tools will have passageways of various structures, often having fluid flow through annular passageways, central openings, coiled or tortuous paths, and other arrangements for various purposes. The fluid may be directed through a tortuous passageway or other fluid passages to provide further filtration, fluid control, pressure drops, etc. The fluid then flows into the inflow control device, if present. Various inflow control devices are well known in the art and are not described here in detail. An example of such a flow control device is commercially available from Halliburton Energy Services, Inc. under the trade mark EquiFlow®. Fluid then flows into the inlet 42 of the autonomous fluid control system 25. While suggested here that the additional inflow control device be positioned upstream from the inventive device, it could also be positioned downstream of the inventive device or in parallel with the inventive device.

Figure 3:
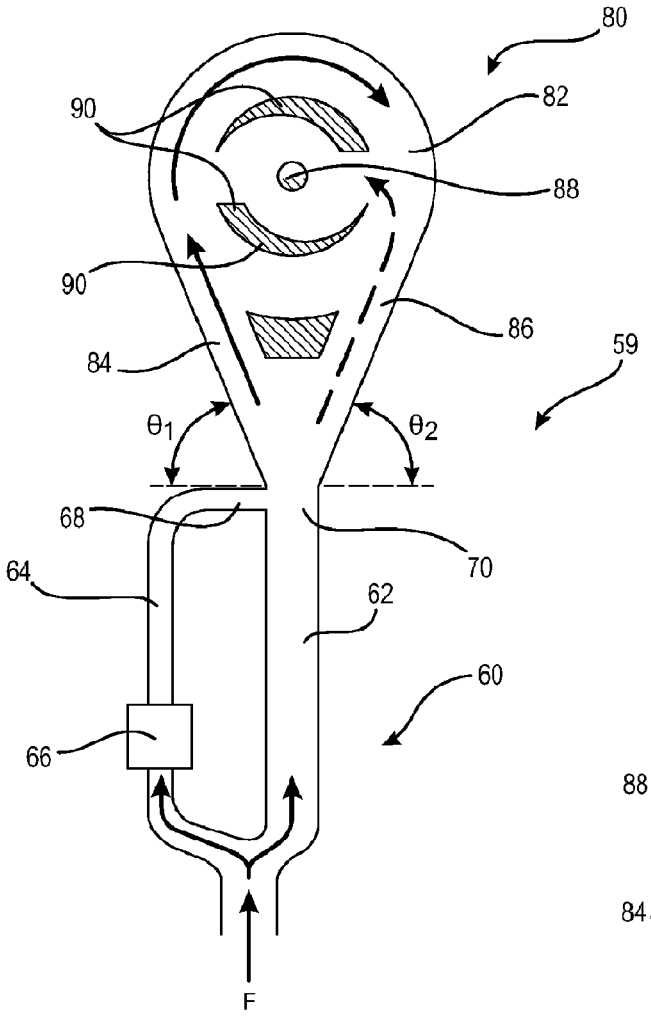
FIG. 3 is a plan view of an autonomous fluid control system having a flow control assembly and vortex assembly according to an embodiment of the invention.

FIG. 3 is a plan view of an autonomous fluid control system 59 having a flow control assembly 60 and vortex assembly 80 according to an embodiment of the invention. The flow control assembly 60 has a first or primary fluid flow passageway 62 and a second or control passageway 64. The second passageway acts to control or direct fluid flow as it exits the primary passageway. An autonomous fluid diverter assembly 66 is positioned along the second passageway 64 and selectively restricts fluid flow through that passageway. The second passageway outlet 68 is adjacent the first passageway outlet 70, such that fluid exiting the second passageway will direct the fluid exiting the first passageway outlet 70.

As used herein, the "primary passageway" may more generally be referred to as a first passageway, in that the primary or first passageway does not necessarily require that a majority of the fluid flowing through the flow control assembly flow through the primary passageway. Similarly, the control passageways may more generally be referred to as "second passageway," "third passageway," etc. Further, the fluid flowing from, or exiting, the control passageway(s) is referred to as "directing" the fluid flow from the primary passageway. Obviously the flow from the passageways will influence each other, determining the ultimate direction or pattern of flow of the merged or mingled fluid. For sake of reference, the flow from the control passageway(s) having the diverter assembly therein is typically referred to as "directing" the flow from the primary passageway. The Figures show exemplary passageway designs; those of skill in the art will recognize additional arrangements, including alternate designs for passageway length, shape, positioning of inlets and outlets in relation to one another, angles of intersection of fluid flows and passageways, location of passageway outlets with respect to one another and the vortex assembly, etc.

The vortex assembly 80 has a vortex chamber 82, a first fluid inlet 84, a second fluid inlet 86, and a vortex chamber outlet 88. The vortex assembly 80 can also include various directional elements 90, such as vanes, grooves, dividers, etc., as shown and as known in the art. The first fluid inlet 84 directs fluid into the vortex chamber to create a spiral or centrifugal flow pattern. Such a spiral flow pattern is indicated by the solid-line arrows in FIG. 3. The first fluid inlet, as shown, can flow fluid into the vortex chamber substantially tangentially (as opposed to radially) to create such a flow pattern. Such a flow pattern produces a greater pressure drop across the vortex assembly, as explained in references incorporated herein. The second fluid inlet 86 directs fluid into the vortex chamber 82 such that the fluid has little or no spiraling pattern. Rather the fluid flows substantially radially towards the vortex outlet 88. Such a flow pattern is indicated by the dashed-line arrows in FIG. 3. Consequently, a relatively lower pressure drop is induced across the vortex assembly 80. The directional elements 90 can be used to enhance the desired flow patterns.

In use, a fluid F, such as production fluid from a wellbore, flows into the flow control assembly 60 and exits into the vortex assembly 80. A proportion of fluid flows into the primary passageway 62 and a proportion into the control passageway 64. An autonomous fluid diverter 66 is positioned along the control passageway 64, such that fluid must flow through the fluid diverter assembly 66 to continue along the control passageway. When the diverter assembly is "open," that is, when fluid flows through the control passageway without restriction, the fluid flows through the control passageway 64 and impinges upon or directs the fluid flow exiting the primary passageway 62 such that the fluid flows towards the second fluid inlet 86 of the vortex assembly 80. Alternately, when the fluid diverter assembly is "closed," or restricting fluid flow through the control passageway 64, the fluid flowing through the primary passageway 62 is directed into the first fluid inlet 84 of the vortex assembly. In one embodiment, when the flow from the control passageway is restricted, the fluid flow from the primary passageway 62 will tend to "stick" to the wall on the first fluid inlet 84 side of the device since the first fluid inlet angle $\theta 1$ is greater than the second fluid inlet angle $\theta 2$. The angles, directional devices, fluid control system outlets and vortex assembly inlets can be altered in design, as taught in the references incorporated herein and as will be apparent of those of skill in the art.

In FIG. 3, the control passageway 64 is shown positioned such that fluid flow from the control passageway directs fluid flow from the primary passageway 62 toward the second flow inlet 86 of the vortex assembly 80, resulting in substantially radial flow through the vortex chamber. The system can be arranged such that fluid flow from the control passageway 64 directs fluid into the first fluid inlet of the vortex assembly, resulting in substantially centrifugal flow in the chamber. For example, the control passageway 64 can be positioned on the opposite "side" of the device. Similarly, the vortex assembly can be "reversed" such that θ2 is greater than θ1, thereby having fluid from the control passageway direct fluid from the primary passageway into centrifugal flow in the vortex chamber. The directional elements can be designed accordingly. Thus, the system can be designed to select for, or allow relatively free flow of, either a relatively higher or lower density fluid.

The fluid diverter assembly 66 is an autonomous device which restricts or allows relatively free flow therethrough in response to changes in a fluid characteristic, such as density. A movable fluid diverter is positioned in the assembly 66 and moves in response to density changes in the fluid. The movable fluid diverter is designed to have a pre-selected effective density such that it will "float" and "sink" as the fluid density changes over time. Details of the fluid diverter assembly are explained elsewhere herein. When the fluid diverter assembly is in the open position, allowing relatively free fluid flow therethrough, the fluid exiting the control passageway directs fluid exiting the primary passageway towards the second flow inlet. Radial flow results in the vortex chamber, with consequent low pressure drop, and fluid flow across the system is relatively increased. When the fluid diverter assembly is in a closed position, fluid flow through the control passageway 64 is restricted, and flow from the primary passageway 62 flows into the first fluid inlet 84, being "directed" by the reduced fluid flow from the control passageway. Consequently, the fluid creates a centrifugal flow in the vortex chamber with resultant higher pressure drop and restricted fluid flow across the system. Since the autonomous fluid diverter assembly opens and closes in response to fluid density change, the system autonomously restricts flow based on such a change.

The system can restrict flow of water and select flow of oil, restrict water and select gas, restrict gas and select oil, etc. The system can be used in production of fluids from a formation, in injection methods, or otherwise, as will be apparent to those of skill in the art. Most of the examples herein will refer to production of formation fluid for ease of description.

As an example, the system of FIG. 3 can be used to restrict production of water and allow relatively free production of oil. As the constituency of the production fluid changes in over time, its density will also change. The fluid diverter valve assembly, as will be explained, has a movable fluid diverter of an effective density between that of oil and water. When the production fluid has a relatively higher proportion of water, or the density moves closer to that of water, the diverter will move or "float" in the greater density fluid. The fluid diverter moves to a position wherein fluid flow through the fluid diverter assembly 66, and therefore the control passageway 64, is restricted. Consequently, the fluid exiting the primary passageway is directed into the first fluid inlet 84, centrifugal flow is induced in the vortex chamber, and production is restricted. (The term restricted is understood to include but not require complete prevention of flow.) When the fluid density changes to closer to that of oil, and lower than that of the effective density of the diverter, the diverter will move or "sink" into a position where fluid flow through the control passageway 64, is relatively free or unrestricted. Consequently, fluid will exit from the control passageway 64, directing the fluid exiting the primary passageway 62 into the second fluid inlet 86. The radial flow in the vortex chamber results in a relatively low pressure drop across the vortex assembly and production of fluid is relatively free.

Figure 4:
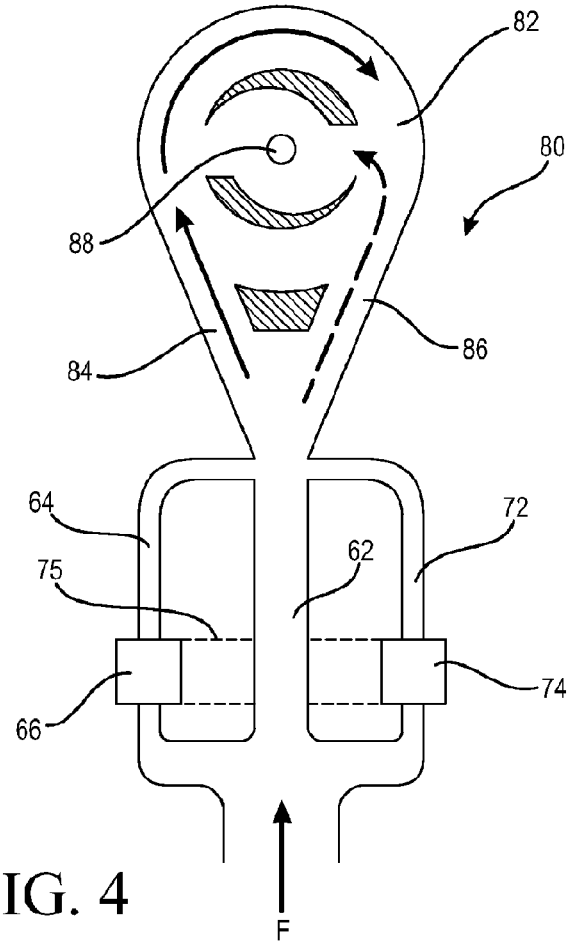
FIG. 4 is a plan view of an autonomous fluid control system having a flow control assembly and vortex assembly according to an embodiment of the invention.

FIG. 4 is a plan view of an autonomous fluid control system having a flow control assembly 60 and vortex assembly 80 according to an embodiment of the invention. In this embodiment, an additional control passageway 72, or third passageway, is present to further assist in directing fluid flow. Fluid flow from the additional control passageway 72, influences or directs flow from the primary passageway. For example, when fluid is unrestricted through the third passageway 72, the fluid flow directs the flow from the primary passageway towards the first fluid inlet 84.

As further seen in FIG. 4, a second fluid diverter assembly 74 can optionally be employed on the additional control passageway 72. The fluid diverter assembly 74 is preferably designed to be open when the fluid diverter assembly 66 along control passageway 64 is closed, and vice versa. In such an embodiment, it is not necessary to rely on the fluid to "stick" to the wall having the smaller inlet angle. Instead, the fluid from the control passageways will direct the primary passageway fluid into the appropriate fluid inlet of the vortex assembly. One or more control passageways and their corresponding inlet angles can be used in conjunction to control fluid flow in the system.

As also indicated in FIG. 4, by dashed lines, a single fluid diverter assembly 75 can be connected to both control passageways 64 and 72. In one such arrangement, a movable fluid diverter moves between a position restricting fluid flow through one control passageway to a position restricting fluid flow through the other passageway. For example, where the system is used to select for production of fluid when it is a greater proportion of oil over fluid of a greater proportion of water, a movable diverter having an effective density between that of oil and water, will "float" into a position in the fluid diverter assembly to restrict fluid flow through control passageway 64. Thus, fluid flow through control passageway 72 will direct fluid from the primary passageway 62 into the first flow inlet 84. The resulting spiral flow pattern in the vortex chamber will relatively restrict fluid production across the system. Alternately, when the fluid changes in density to closer to that of oil, the movable fluid diverter will "sink" to a position in the diverter assembly to restrict fluid flow through control passageway 72. Consequently, fluid from the primary passageway will be directed into the second fluid inlet 86. Correspondingly, fluid flow in the vortex will be substantially radial and flow across the system relatively unrestricted.

Several embodiments of the autonomous fluid diverter assembly 66 for use in conjunction with control passageways are presented in the following Figures.

Figure 5:
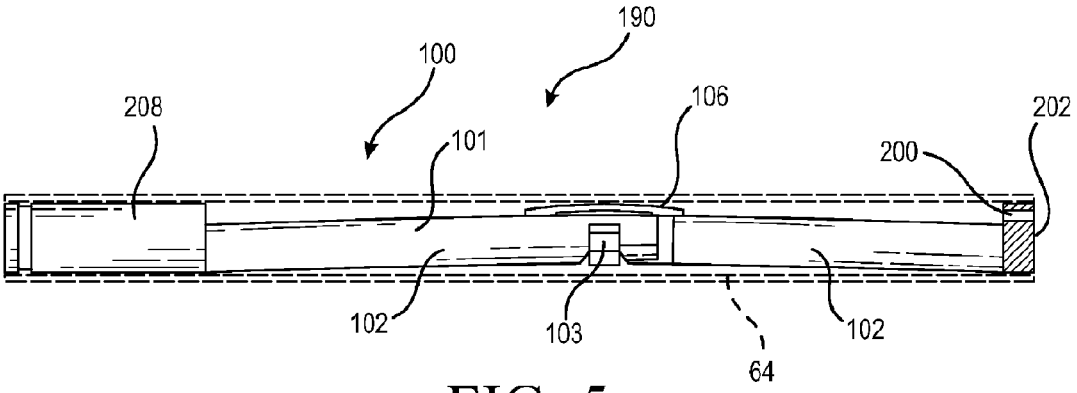
FIG. 5 is an elevational view of an exemplary fluid diverter assembly in an open position, in partial cross-section, according to an embodiment of the invention.
Figure 6:
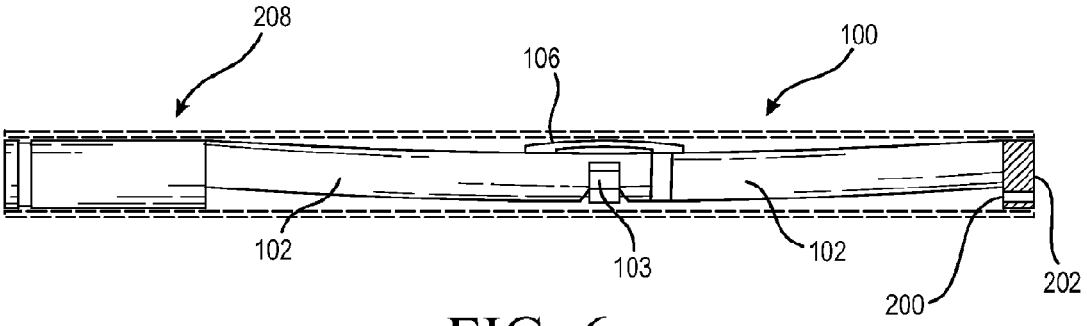
FIG. 6 is an elevational view of an exemplary fluid diverter assembly as in FIG. 5 but in a closed position, and in partial cross-section.

FIG. 5 is an elevational view of an exemplary fluid diverter assembly in an open position, according to an embodiment of the invention. FIG. 6 is an elevational view of an exemplary fluid diverter assembly in an open position, according to an embodiment of the invention.

The autonomous fluid diverter assembly 190 is positioned within a control passageway 64. In FIG. 5, the fluid diverter assembly 190 includes a diverter sub-assembly 100. The diverter sub-assembly 100 has a fluid diverter 101 with two diverter arms 102. The diverter arms 102 are connected to one another and pivot about a pivoting joint 103. The diverter 101 is manufactured from a substance of a density selected to actuate the diverter arms 102 when the downhole fluid reaches a preselected density.

The fluid diverter 101 is actuated by change in the density of the fluid in which it is immersed and the corresponding change in the buoyancy of the diverter 101. When the effective density of the diverter 101 is higher than the fluid, the diverter will "sink" to the position shown in FIG. 5, referred to as the closed position since fluid flow is restricted through the control passageway 64. In the exemplary embodiment shown, when the diverter 101 is in the closed position, fluid flow is restricted through the internal conduit 200 in plate 202.

If the formation fluid density increases to a density higher than that the effective density of the diverter 101, the change will actuate the diverter 101, causing it to "float" and moving the diverter 101 to the position shown in FIG. 6. The fluid diverter assembly is in a closed position in FIG. 6 since the diverter 100 is adjacent the internal conduit 200, thereby restricting flow through the internal conduit. The shape and design of the internal conduit and plate can be modified as those of the art will understand; the function is to restrict flow through the control passageway when the diverter assembly is in a closed position and allow relatively unrestricted flow through the control passageway when the diverter assembly in an open position. In the exemplary embodiment shown, a stop 208 is positioned in the control passageway 64 and adjacent the diverter 101 to prevent the diverter from moving longitudinally in the control passageway. The stop maintains the diverter in a position adjacent the away from the internal conduit 200. Fluid flows around or through the stop. Details of construction are not shown.

In use, fluid enters the control passageway, flows by the stop, and actuates the diverter assembly, moving it to an open or closed position. If in an open position, fluid continues past the diverter assembly and through the control passageway to direct flow from the primary passageway. If in a closed position, fluid is restricted from flowing through the control passageway by the diverter. An alternate embodiment, wherein fluid flow enters the passageway along the central section of the diverter and exits at both ends will be understood by those of skill in the art and in light of descriptions in incorporated references.

The arms will move between the open and closed positions in response to the changing fluid density. In the embodiment seen in FIG. 5, the diverter 101 material is of a higher density than the typical downhole fluid. In such a case, a biasing mechanism 106 can be used, here shown as a leaf spring, to offset gravitational effects such that the diverter arms 102 will move to the closed position even though the diverter arms are denser than the downhole fluid. Stated another way, the biasing mechanism can be used to select an effective density of the diverter, as desired, since it is the effective density that determines whether the diverter will sink or float in the fluid.

Other biasing mechanisms as are known in the art may be employed such as, but not limited to, counterweights, other spring types, etc., and the biasing mechanisms can be positioned in other locations, such as at or near the ends of the diverter arms. Here, the biasing spring 106 is connected to the two diverter arms 102, tending to pivot them upwards and towards the position seen in FIG. 6. The biasing mechanism and the force it exerts are selected such that the diverter arms 102 will move to the position seen in FIG. 6 when the fluid reaches a preselected density. The density of the diverter arms and the force of the biasing spring are selected to result in actuation of the diverter arms when the fluid in which the apparatus is immersed reaches a preselected density.

The dual-arm design seen in FIGS. 5-6 can be replaced with a single arm or single element design. A single arm design can pivot, attached to a pivot point at or near one end. A floating, or unattached, element design simply floats up and sinks down within the passageway.

Note that the embodiment as seen in FIGS. 5-6 can be modified to restrict production of various fluids as the composition and density of the fluid changes. For example, the embodiment can be designed to restrict water production while allowing oil production, restrict oil production while allowing natural gas production, restrict water production while allowing natural gas production, etc. The assembly can be designed such that it is open when the diverter is in a "floating" or buoyant position, by moving the location of the internal conduit for example, or can be designed to be open where the diverter is in a "sunk" or lower position (as seen in FIG. 5).

FIGS. 7-11 are views of another embodiment of a fluid diverter assembly 390 having a rotating diverter 301 positioned in a control passageway 302.

Figure 7:
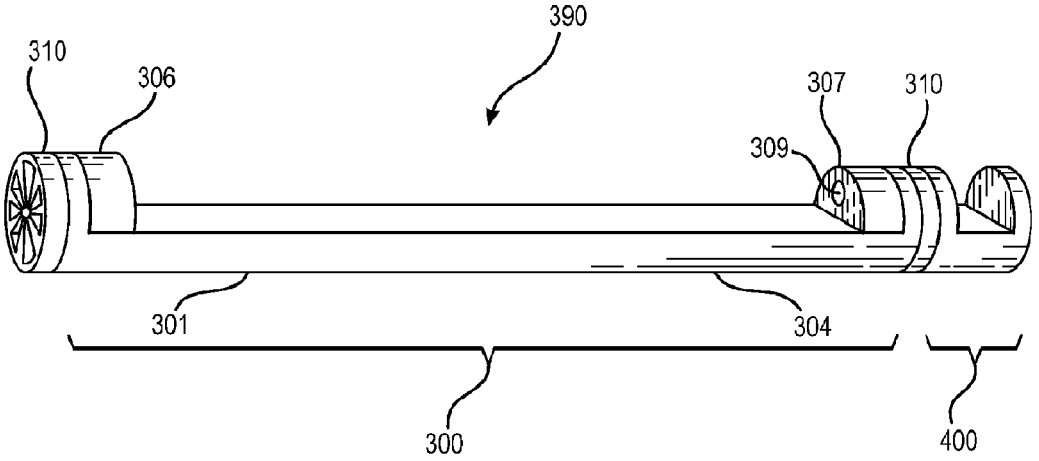
FIG. 7 is an elevation view of another embodiment of a fluid diverter assembly having a rotating diverter.

FIG. 7 is an elevation view of another embodiment of a fluid diverter assembly 390 having a rotating diverter 301. The fluid diverter assembly 390 includes a fluid diverter sub-assembly 300 with a movable fluid diverter 301. The diverter 301 is mounted for rotational movement in response to changes in fluid density. The exemplary diverter 301 shown is semi-circular in cross-section along a majority of its length with circular cross-sectional portions at either end.

The embodiment will be described for use in selecting production of a higher density fluid, such as oil, and restricting production of a relatively lower density fluid, such as natural gas. In such a case, the diverter is "weighted" by high density counterweight portions 306 and 307 made of material with relatively high density, such as steel or another metal. The portion 304, shown in an exemplary embodiment as semi-circular in cross section, is made of a material of relatively lower density, such as plastic. The diverter portion 304 is more buoyant than the counterweight portions 306 and 307 in denser fluid, causing the diverter to rotate to the upper or open position seen in FIGS. 8 and 10. Conversely, in a fluid of relatively lower density, such as natural gas, the diverter portion 304 is less buoyant than the counterweight portions 306 and 307, and the diverter 301 rotates to a closed position as seen in FIGS. 7 and 9. A biasing element, such as a spring, can be used in conjunction with or instead of the counterweight, as will be apparent to those of skill in the art. The selection of materials and biasing elements results in an effective density for the diverter.

Figure 10:
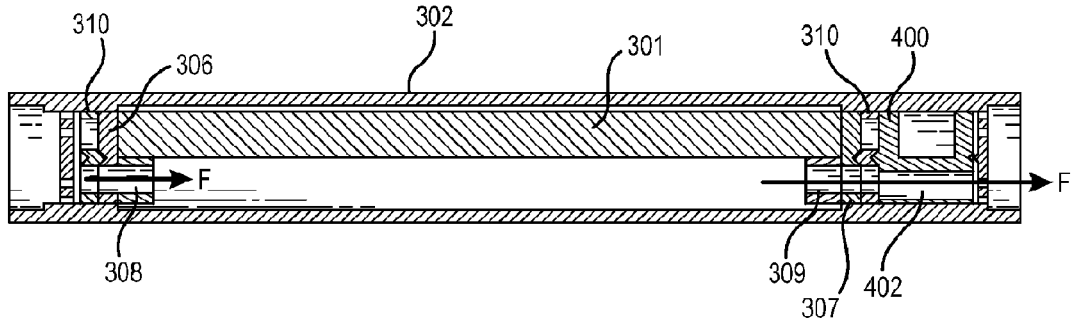
FIG. 10 is an elevational view of the embodiment seen in FIG. 9 positioned in a passageway and in an open position.

The counterweight portions 306 and 307 each have an internal conduit defined therethrough. In the preferred embodiment, the upstream counterweight 306 has an internal conduit 308 to allow fluid into the portion of the passageway having the diverter so the diverter can respond to the fluid density. Multiple conduits 308 can be used since the upstream counterweight (in this embodiment) does not need to align with other conduits. The downstream counterweight portion 307 has an internal conduit 309 to align with the internal conduit 402 of the plate 400 when the diverter assembly is open, as seen in FIG. 10. A person of skill in the art will recognize a wide variety in potential design of the internal conduits and/or plate 400. However, fluid flow is allowed through the passageway when the diverter assembly is open and restricted when the assembly is closed.

Figure 8:
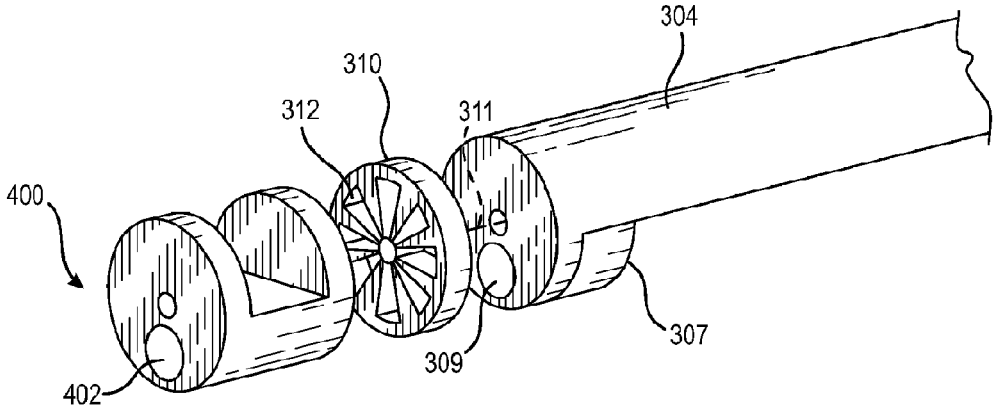
FIG. 8 is an exploded detail view of one end of the fluid diverter assembly of FIG. 7.
Figure 9:
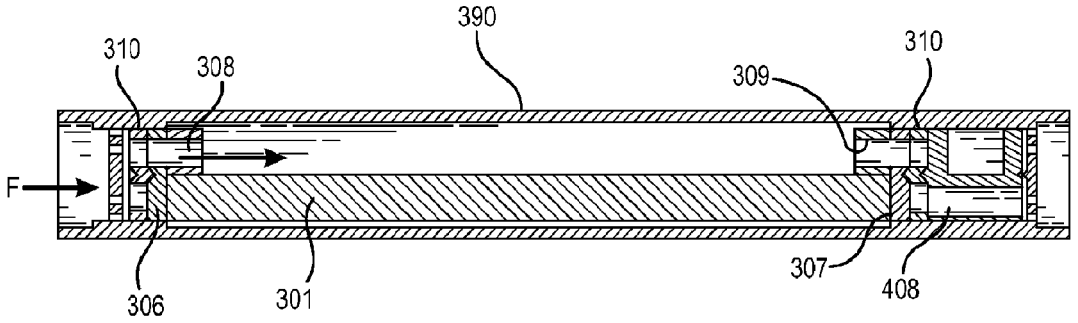
FIG. 9 is an elevational view of the embodiment seen in FIG. 7 positioned in a passageway and in a closed position.

FIG. 8 is an exploded detail view of one end of the fluid diverter assembly of FIG. 7. (Note that the view is reversed from that of FIG. 7.) Since the operation of the assembly is dependent on the movement of the diverter 301 in response to fluid density, the assembly must be oriented such that the diverter aligns the internal conduit 402 appropriately. The plate 400, having an internal conduit 402 therethrough, is oriented in the wellbore. A preferred method of providing orientation is to use a self-orienting assembly which is weighted to cause rotation of the plate within the passageway. The self-orienting assembly is sometimes referred to as a "gravity selector." The plate 400 is weighted (or otherwise biased) to orient such that the internal conduit 402 is in the correct location once the entire assembly is in position in the wellbore. One advantage of the diverter design having a longitudinal rotation is that the diverter assembly does not require orientation once in place in a wellbore. Rather, only the internal conduit (and plate or element through which the conduit passes) need be oriented. In the example shown, the internal conduit 402 is to be positioned in the lower half of the control passageway, as shown. Other methods of orienting the conduit will be apparent to those of skill in the art.

In use, the diverter 301 rotates about its longitudinal axis 311 between open and closed positions. When in the open position, the internal conduit 309 of the diverter 301 is aligned with the internal conduit 402 of the plate 400 and fluid flows through the diverter assembly and through the control passageway 302. In the closed position, the conduits are not aligned and flow through the internal conduit 402 is restricted.

In the preferred embodiment shown, the assembly further includes fixed support members 310 with multiple ports 312 therethrough to facilitate fluid flow through the fixed support.

In use, the buoyancy of the diverter creates a torque which rotates the diverter 301 about its longitudinal rotational axis 311. The torque produced must overcome any frictional and inertial forces tending to hold the diverter in place. Note that physical constraints or stops can be employed to constrain rotational movement of the diverter; that is, to limit rotation to various angles of rotation within a preselected arc or range. The torque will then exceed the static frictional forces to ensure the diverter will move when desired. Further, the constraints can be placed to prevent rotation of the diverter to top or bottom center to prevent possibly getting "stuck" in such an orientation. In one embodiment, the restriction of fluid flow is directly related to the angle of rotation of the diverter within a selected range of rotation. The internal conduit 309 of the diverter 301 aligns with the conduit 408 of the plate 400 when the diverter is in a completely open position. The alignment is partial as the diverter rotates towards the open position, allowing greater flow as the diverter rotates into the fully open position. The degree of flow is directly related to the angle of rotation of the diverter when the diverter rotates between partial and complete alignment with the plate conduit.

Figure 11:
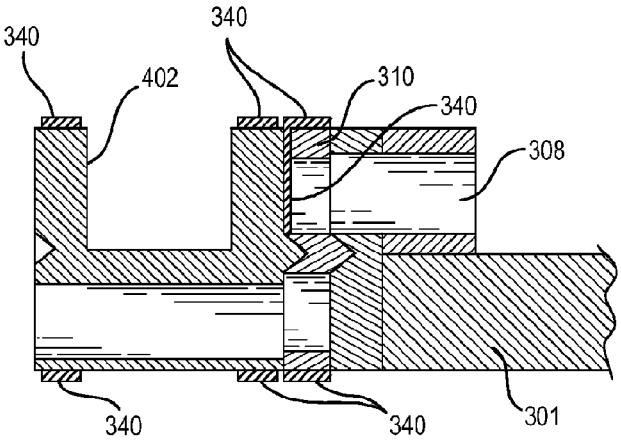
FIG. 11 is a detail, cross-sectional view of a gravity selector from FIG. 7.

Once properly oriented, the self-orienting plate 400 can be sealed into place to prevent further movement of the valve assembly and to reduce possible leak pathways. In a preferred embodiment, as seen in FIG. 11, a sealing agent 340 has been placed around the exterior surfaces of the plate 400. Such an agent can be a swellable elastomer, an o-ring, an adhesive or epoxy that bonds when exposed to time, temperature, or fluids for example. The sealing agent 340 may also be placed between various parts of the apparatus which do not need to move relative to one another during operation, such as between the plate 400 and fixed support 310 as shown. Preventing leak paths can be important as leaks can potentially reduce the effectiveness of the apparatus. The sealing agent should not be placed to interfere with rotation of the diverter 301.

The invention described above can be configured to select oil production over water production based on the relative densities of the two fluids. In a gas well, the fluid control apparatus can be configured to select gas production over oil or water production. Where fluid flow is desired through the control passageway when the fluid is of a lower density, such as where the diverter should allow flow in oil but restrict flow in water, the orientation of the diverter will be reversed for the open and closed positions. A corresponding change will be preferred in the location of the plate conduit 402 to allow flow when appropriate. The invention described herein can also be used in injection methods. In an injection operation, the control assembly operates to restrict flow of an undesired fluid, such as water, while not restricting flow of a desired fluid, such as steam or carbon dioxide. The invention described herein can also be used on other well operations, such as work-overs, cementing, reverse cementing, gravel packing, hydraulic fracturing, etc. As with the embodiments described elsewhere herein, the embodiment in FIGS. 7-11 can be used to open and close the control passageway in response to a fluid of pre-selected density.

Figure 12:
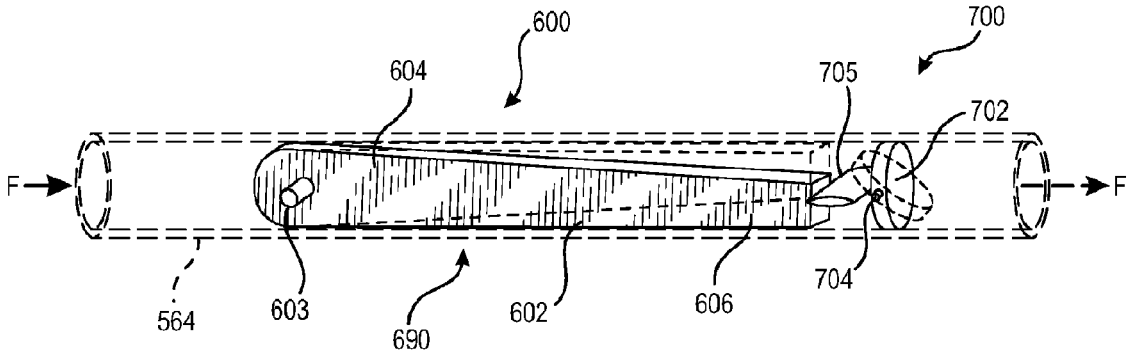
FIG. 12 is an orthogonal view of an embodiment of an autonomous fluid diverter assembly having a pivoting diverter arm.

FIG. 12 is an orthogonal view of an embodiment of an autonomous fluid diverter assembly having a pivoting diverter arm. The fluid diverter assembly 690 has a fluid diverter sub-assembly 600 and a valve sub-assembly 700 positioned in a control passageway 564. The diverter assembly 600 includes a diverter arm 602 which rotates about pivot 603 between a closed position, seen in FIG. 12 in solid lines, and an open position, seen in dashed lines. The diverter arm 602 is actuated by change in the density of the fluid in which it is immersed. Similar to the descriptions above, the diverter arm 602 has less buoyancy when the fluid flowing through the control passageway 564 is of a relatively low density and moves to the closed position. As the fluid changes to a relatively higher density, the buoyancy of the diverter arm 602 increases and the arm is actuated, moving upward to the open position. The pivot end 604 of the diverter arm has a relatively narrow cross-section, allowing fluid flow on either side of the arm. The free end 606 of the diverter arm 602 is of a larger cross-section, preferably of a substantially rectangular cross-section, which restricts flow through a portion of the passageway. For example, the free end 606 of the diverter arm 602, as seen in FIG. 12 in solid lines, restricts fluid flow along the bottom of the passageway, while in the position shown in dashed lines flow is restricted along the upper portion of the passageway. The free end of the diverter arm does not entirely block flow through the passageway.

The valve sub-assembly 700, in an exemplary embodiment, includes a rotating valve member 702 mounted pivotally in the control passageway 564 and movable between a closed position, seen in FIG. 12 in solid lines, wherein fluid flow through the passageway is restricted, and an open position, seen in dashed lines, wherein the fluid is allowed to flow with less restriction. The valve member 702 rotates about pivot 704. The valve sub-assembly can be designed to partially or completely restrict fluid flow when in the closed position. It may be desirable to allow a "leak" or some minimal flow to prevent the valve becoming stuck in the closed position. A stationary flow arm 705 can be utilized to further control fluid flow patterns through the passageway.

Movement of the diverter arm 602 affects the fluid flow pattern through the control passageway 564. When the diverter arm 602 is in the lower or closed position, fluid flowing through the passageway is directed primarily along the upper portion of the passageway. Alternately, when the diverter arm 602 is in the upper or open position, shown in dashed lines, fluid flowing through the passageway is directed primarily along the lower portion of the passageway. Thus, the fluid flow pattern is affected by the density of the fluid compared to the effective density of the fluid diverter. In response to the change in fluid flow pattern, the valve sub-assembly 700 moves between the open and closed positions. In the embodiment shown, the assembly is designed to select, or allow flow of, a fluid of a relatively higher density. That is, a more dense fluid, such as oil, will cause the diverter arm 602 to "float" to an open position, thereby affecting the fluid flow pattern and opening the valve sub-assembly 700. As the fluid changes to a lower density, such as gas, the diverter arm 602 "sinks" to the closed position and the affected fluid flow causes the valve assembly 700 to close, restricting flow of the less dense fluid. The assembly can be designed to select for either more or less dense fluids based on arrangement of the elements, such as moving the offset of the valve element pivot axis, a directional element such as flow arm 705, or a biasing element.

A biasing element, such as a counterweight or spring, may be used to adjust the fluid density at which the diverter arm "floats" or "sinks" and can also be used to allow the material of the diverter arm to have a significantly higher density than the fluid where the diverter arm "floats." As explained above, the relative buoyancy or effective density of the diverter arm in relation to the fluid density will determine the conditions under which the diverter arm will change between open and closed or upper and lower positions. Fluid flows from the control passageway 564 to direct fluid flow exiting the primary passageway when the valve sub-assembly is in the open position.

Figure 13:
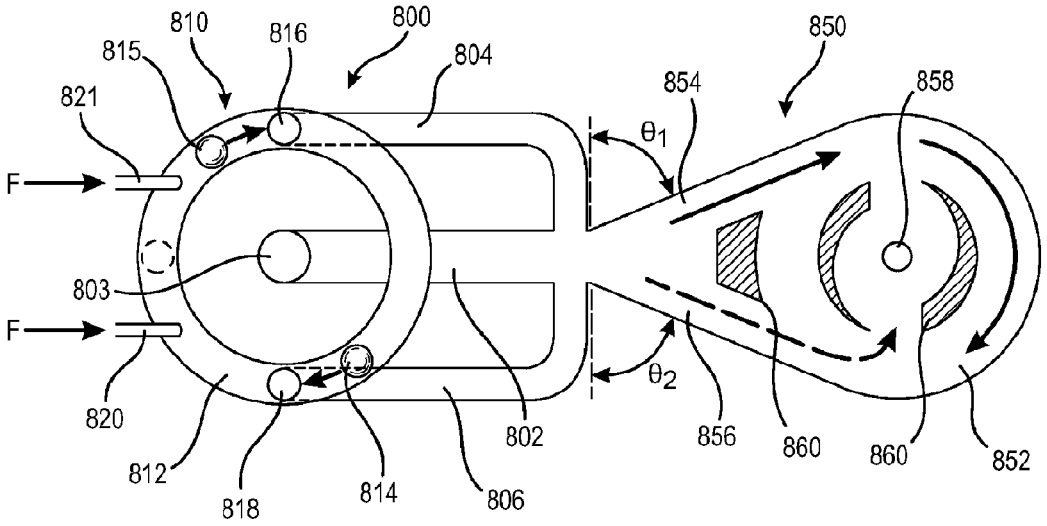
FIG. 13 is a plan view of a fluid control assembly according to an embodiment of the invention.

FIG. 13 is a plan view of a fluid control assembly according to an embodiment of the invention. A flow control assembly 800 has a first or primary passageway 802 and two control passageways, namely, a second passageway 804 and a third passageway 806. Fluid is supplied to the primary passageway 802 at inlet 803. Bridging the two control passageways is a fluid diverter assembly 810 having a diverter passageway 812 providing fluid communication between the two control passageways. The diverter assembly 810 includes at least one diverter element 814 which moves within the diverter passageway 812. The second passageway has an opening 816 into the diverter passageway 812. The third passageway has an opening 818 onto the diverter passageway 812. Inlet passageways 820 and 821 provide fluid to the diverter passageway 812. A different number of inlet passages can be employed. The inlet passageways are preferably designed to allow a relatively small or slow flow of fluid through the diverter passageway. In the preferred embodiment shown, the inlet passageways are relatively small in diameter. Further, the assembly is preferably designed to produce a relatively low pressure drop across the diverter passageway. This is preferred so that the buoyancy force moving the diverter element 814 is stronger, and can overcome, the hydrodynamic force acting on the diverter element.

In one embodiment, the diverter element 814 is a single ball which moves along the diverter passageway 812. The diverter element 814 moves in response to change in fluid density. When the density of the fluid is relatively high, the diverter element floats, and moves to an upper position wherein fluid flow through the opening 816 into the second passageway 804 is restricted. At the same time, the fluid flow into the third passageway 806 through opening 818 is unrestricted. Thus, fluid flow from the third passageway directs the fluid flow exiting the primary passageway 802 towards the first inlet 854 of the vortex assembly 850. A spiral or centrifugal flow pattern is induced in the vortex chamber 852, as indicated by the solid arrows, and fluid flow through the assembly is relatively restricted. Conversely, when the fluid changes to a relatively low density, the diverter element 814 moves or sinks to a position restricting fluid flow through the opening 818 into the third passageway 806. Simultaneously, flow into the second passageway 804 is unrestricted. Thus, fluid flow from the second passageway 804 directs fluid flow from the primary passageway 802 towards the second fluid 856 of the vortex assembly 850. Fluid then flows through the vortex chamber substantially radially toward vortex outlet 858, as indicated by the dashed arrows, and fluid flow through the assembly is relatively unrestricted.

In such an embodiment, the relatively lower density fluid is selected for production. A higher density fluid can be selected by altering the inlet angles θ1 and θ2, altering the directional elements 860, etc., as explained elsewhere herein and as will be apparent to those of skill in the art.

The diverter element is shown as a spherical ball but can take other shapes, such as a slug, pellet, oblong shape, etc.

In another embodiment, multiple diverter elements, such as diverter elements 814 and 815, are used simultaneously. The first diverter element 814 moves along the diverter passageway 812 between a position restricting fluid flow into the second passageway and a position wherein such flow is unrestricted. The second diverter element 815 moves along the diverter passageway 812 between a position restricting flow into the third passageway and a position wherein such flow is unrestricted. The movement of the diverter elements can be limited, such as by stops or pins, so the diverter elements remain proximate the second and third passageway openings.

The assembly shown in FIG. 13, in a preferred embodiment, includes a gravity selector or some other means for orienting the assembly such that the diverter element(s) can float and sink along the diverter passageway into appropriate alignment.

In several of the embodiments discussed herein, at least a portion of the fluid control assembly needs to be oriented such that the diverter or diverter element can float and sink properly. A gravity selector is discussed above with respect to FIGS. 7-11, for example. A gravity selector or other orientation means can be used to orient the entire fluid control assembly, or just a portion thereof, such as the flow control assembly, control passageway plate, internal conduit, etc.

Figure 14:
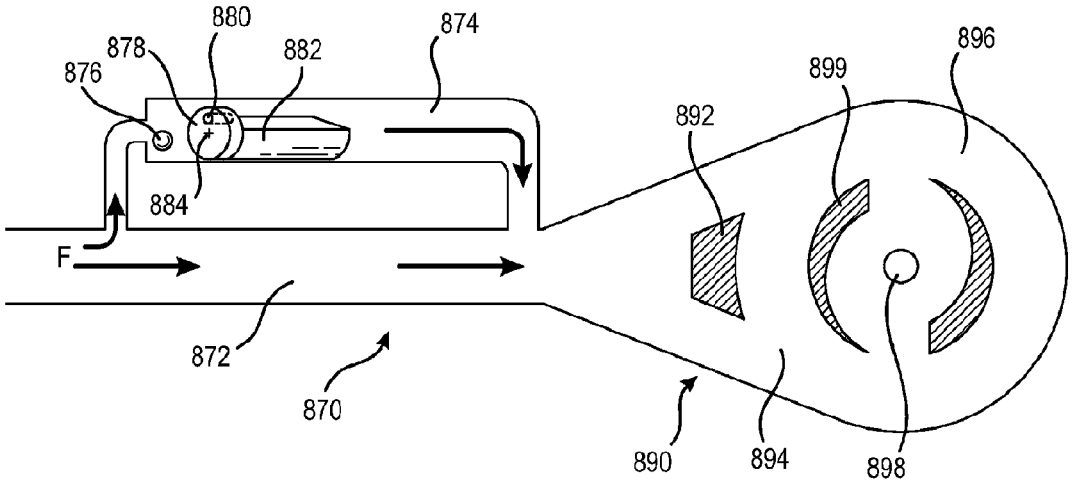
FIG. 14 is a plan view of an embodiment of the present invention having a diverter element and a gravity selector for a control passageway plate.

FIG. 14 is a plan view of an embodiment of the present invention having a diverter element and a gravity selector for a control passageway plate. A flow control assembly 870 has a first or primary passageway 872 and a second or control passageway 874. A density-based diverter element 876 is positioned within the second passageway 874. The diverter element is shown as a floating ball, but can be diverters discussed herein or as known in the art. A plate 878 having an opening 880 therethrough is positioned within the second passageway 874. The plate 878 is attached to or comprises a gravity selector 882 such that the plate orients itself using gravity by rotating about pivot axis 884 such that the opening 880 is effectively positioned.

The diverter element 876 moves between an open position wherein fluid flow through the opening 880 in the plate 878 is relatively unrestricted, and a closed position wherein flow therethrough is relatively restricted. Although the design of the diverter and plate may vary, the diverter moves between a position restricting flow through the control passageway and a position wherein such flow is unrestricted.

Operation and design of the vortex assembly is well understood by the discussion above and will not be repeated here. The vortex assembly 890 has a first fluid inlet 892, a second fluid inlet 894, an outlet 898, a vortex chamber 896 and optional directional elements 899.

Figure 15:
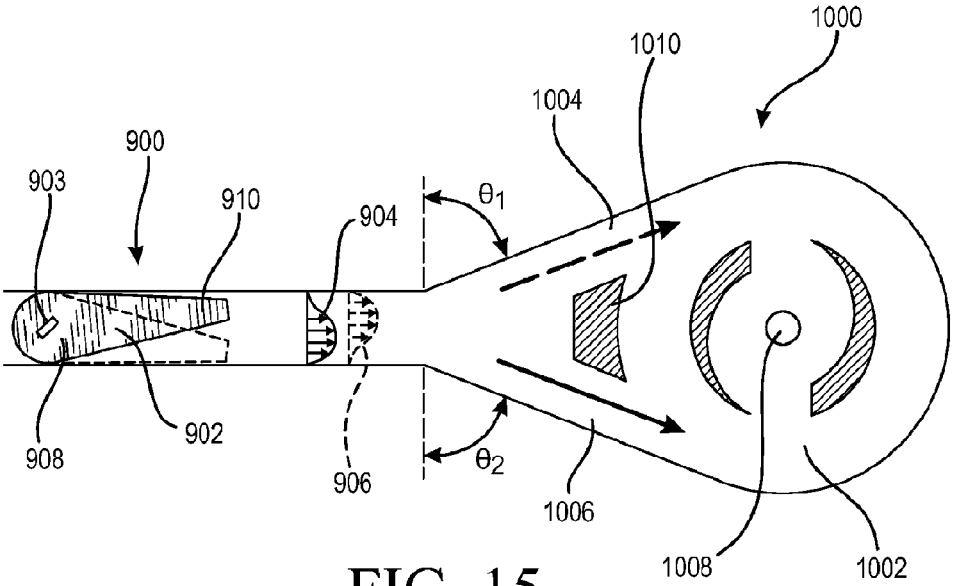
FIG. 15 is an orthogonal view of an autonomous valve assembly or autonomous fluid control assembly according to another aspect of the invention.

FIG. 15 is an orthogonal view of an autonomous valve assembly according to another aspect of the invention. In this embodiment, a movable, density-based flow diverter assembly 900 is positioned in the primary passageway 862 (the only passageway in a preferred embodiment) leading to the vortex assembly 1000. The diverter assembly operates to alter the velocity profile of the fluid flowing through the passageway rather than operating to restrict flow through a conduit. The diverter assembly 900 has a movable, in this case pivotable, diverter arm 902, which pivots about mounting arm 903. The diverter arm 902 has a shape as described above in relation to FIG. 12. Other types of density-driven diverter can be employed in place of the pivoting diverter shown.

The diverter arm 902 alters the fluid flow pattern in the passageway 862. For example, the positioning of the diverter 902 alters the velocity profile, as seen at 904. Although the invention is discussed in relation to a velocity profile, it can also apply to a flow rate profile, etc. When the diverter 902 is proximate the upper portion of the passageway 862, the velocity of the fluid is greatest at the bottom portion of the passageway, as indicated. When the diverter moves to a position proximate the bottom of the passageway, the velocity profile is reversed. The change in flow pattern in the passageway directs the fluid flow into either the first flow inlet 1004 or the second flow inlet 1006 of the vortex assembly 1000, optionally assisted by directional elements 1010, as shown. The resulting flow in the vortex chamber 1002 and eventually to vortex outlet 1008 is as described elsewhere herein. Consequently, a preferred fluid, such as oil, can be directed into the chamber to flow substantially radially, while an undesired fluid, such as water, is restricted by being directed into a substantially spiral flow. The embodiment can be altered to select for any desired fluid, such as gas over water, etc., as explained herein, by altering the effective density of the diverter, the inlet angles of the vortex assembly, etc. The assembly may need to be gravity oriented as described elsewhere herein.

The concept described with respect to FIG. 15, wherein a movable, density-based diverter is utilized to alter the velocity profile within a passageway and thereby direct the fluid flow exiting the passageway, can be used in conjunction with the multiple flow passageway embodiments described herein.

The inventions described herein can also be used with other flow control systems, such as inflow control devices, sliding sleeves, and other flow control devices that are already well known in the industry. The inventive system can be either parallel with or in series with these other flow control systems.

Specifically, the teachings herein can be combined with those in U.S. Patent Application Ser. No. 61/473,699, entitled "Sticky Switch for the Autonomous Valve," to Fripp, filed Apr. 8, 2011.

The embodiments presented herein provide for an apparatus for autonomously controlling fluid flow in a subterranean well, the fluid having a density which changes over time, the apparatus comprising: a vortex assembly having a vortex chamber, a vortex outlet, and a first flow inlet and a second flow inlet into the vortex chamber; a fluid control system having a first fluid passageway and a second passageway, fluid exiting the first and second passageway directed into the vortex assembly; and a movable fluid diverter positioned in the second passageway, the fluid diverter moved by change in the fluid density, the fluid diverter movable to restrict fluid flow through the second passageway in response to change in the fluid density. A similar apparatus, wherein the second passageway is for directing fluid flow as it exits the first fluid passageway and into the vortex assembly. A apparatus wherein the fluid control system further comprises a third passageway and a movable fluid diverter positioned in the third passageway. An apparatus wherein the second and third passageways are for directing fluid flow as it exits the first fluid passageway and into the vortex assembly. An apparatus wherein the fluid control system further comprises a third passageway and the movable fluid diverter is movable between the first and second control passageways. An apparatus wherein the movable fluid diverter rotates about a longitudinal axis. An apparatus wherein the movable fluid diverter pivots about a radial axis of the fluid diverter. An apparatus wherein the movable fluid diverter comprises a floating element unattached to the walls of the passageways. An apparatus wherein the movable fluid diverter comprises at least one floating ball. An apparatus wherein the movable fluid diverter is of a preselected effective density and is buoyant in a fluid of a preselected density. An apparatus wherein the fluid diverter is movable between a first and a second position, and wherein the fluid diverter is biased towards the first position by a biasing member. An apparatus wherein the biasing member is a counterweight. An apparatus wherein the fluid diverter moves between a first position in which the fluid diverter restricts fluid flow through the second passageway, and a second position in which fluid flow through the second passageway is unrestricted. An apparatus wherein the fluid diverter rotates to a plurality of rotational angles, and wherein restriction of the fluid flow is related to the rotational angle of the fluid diverter. An apparatus wherein fluid flow through the first flow inlet results in a substantially spiral flow in the vortex chamber. An apparatus wherein fluid flow through the second flow inlet results in a substantially radial flow in the vortex chamber. An apparatus wherein fluid exiting the primary fluid passageway is directed into the first flow inlet of the vortex assembly when the movable fluid diverter is of a lower density than the fluid. An apparatus wherein the fluid diverter sinks in water, and wherein water flowing through the apparatus flows substantially tangentially in the vortex chamber. An apparatus wherein fluid exiting the first fluid passageway is directed into the second flow inlet of the vortex assembly when the movable fluid diverter is of a higher density than the fluid. An apparatus wherein the fluid diverter floats in oil, and wherein oil flowing through the apparatus flows substantially radially in the vortex chamber. An apparatus wherein the movable fluid diverter restricts fluid flow through the second passageway when the movable fluid diverter is of a lower density than the fluid. An apparatus wherein fluid exiting the second passageway directs fluid exiting the first passageway into the vortex chamber to establish substantially radial flow. An apparatus wherein the movable fluid diverter restricts fluid flow through the second passageway when the movable fluid diverter is of a higher density than the fluid. An apparatus wherein fluid exiting the second passageway directs fluid exiting the first passageway into the vortex chamber to induce a substantially tangential flow. An apparatus further comprising a downhole tool for use in a subterranean well, the vortex assembly, fluid control system and movable fluid diverter positioned within the downhole tool. A method of autonomously controlling fluid flow in a subterranean well, the fluid having a density which changes over time, the method comprising the steps of: flowing fluid through a primary fluid passageway of a fluid control system; flowing fluid from the primary fluid passageway into a vortex assembly having a first and second flow inlet into a vortex chamber; flowing fluid through a control passageway of the fluid control system, the control passageway for controlling fluid flow as it exits the primary fluid passageway and into the inlets of the vortex chamber; and moving a movable fluid diverter positioned in the control passageway in response to a change in the fluid density, the fluid diverter movable to restrict fluid flow through the control passageway.

Descriptions of fluid flow control using autonomous flow control devices and their application can be found in the following U.S. patents and patent applications, each of which are hereby incorporated herein in their entirety for all purposes: U.S. patent application Ser. No. 12/635,612, entitled "Fluid Flow Control Device," to Schultz, filed Dec. 10, 2009; U.S. patent application Ser. No. 12/770,568, entitled "Method and Apparatus for Controlling Fluid Flow Using Movable Flow Diverter Assembly," to Dykstra, filed Apr. 29, 2010; U.S. patent application Ser. No. 12/700,685, entitled "Method and Apparatus for Autonomous Downhole Fluid Selection With Pathway Dependent Resistance System," to Dykstra, filed Feb. 4, 2010; U.S. patent application Ser. No. 12/750,476, entitled "Tubular Embedded Nozzle Assembly for Controlling the Flow Rate of Fluids Downhole," to Syed, filed Mar. 30, 2010; U.S. patent application Ser. No. 12/791,993, entitled "Flow Path Control Based on Fluid Characteristics to Thereby Variably Resist Flow in a Subterranean Well," to Dykstra, filed Jun. 2, 2010; U.S. patent application Ser. No. 12/792,095, entitled "Alternating Flow Resistance Increases and Decreases for Propagating Pressure Pulses in a Subterranean Well," to Fripp, filed Jun. 2, 2010; U.S. patent application Ser. No. 12/792,117, entitled "Variable Flow Resistance System for Use in a Subterranean Well," to Fripp, filed Jun. 2, 2010; U.S. patent application Ser. No. 12/792,146, entitled "Variable Flow Resistance System With Circulation Inducing Structure Therein to Variably Resist Flow in a Subterranean Well," to Dykstra, filed Jun. 2, 2010; U.S. patent application Ser. No. 12/879,846, entitled "Series Configured Variable Flow Restrictors For Use In A Subterranean Well," to Dykstra, filed Sep. 10, 2010; U.S. patent application Ser. No. 12/869,836, entitled "Variable Flow Restrictor For Use In A Subterranean Well," to Holderman, filed Aug. 27, 2010; U.S. patent application Ser. No. 12/958,625, entitled "A Device For Directing The Flow Of A Fluid Using A Pressure Switch," to Dykstra, filed Dec. 2, 2010; U.S. patent application Ser. No. 12/974,212, entitled "An Exit Assembly With a Fluid Director for Inducing and Impeding Rotational Flow of a Fluid," to Dykstra, filed Dec. 21, 2010; U.S. patent application Ser. No. 12/983,144, entitled "Cross-Flow Fluidic Oscillators for use with a Subterranean Well," to Schultz, filed Dec. 31, 2010; U.S. patent application Ser. No. 12/966,772, entitled "Downhole Fluid Flow Control System and Method Having Direction Dependent Flow Resistance," to Jean-Marc Lopez, filed Dec. 13, 2010; U.S. patent application Ser. No. 12/983,153, entitled "Fluidic Oscillators For Use With A Subterranean Well (includes vortex)," to Schultz, filed Dec. 31, 2010; U.S. patent application Ser. No. 13/084,025, entitled "Active Control for the Autonomous Valve," to Fripp, filed Apr. 11, 2011; U.S. Patent Application Ser. No. 61/473,700, entitled "Moving Fluid Selectors for the Autonomous Valve," to Fripp, filed Apr. 8, 2011; U.S. Patent Application Ser. No. 61/473,699, entitled "Sticky Switch for the Autonomous Valve," to Fripp, filed Apr. 8, 2011; and U.S. patent application Ser. No. 13/100,006, entitled "Centrifugal Fluid Separator," to Fripp, filed May 3, 2011.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

It is claimed:

1. An apparatus for autonomously controlling fluid flow in a subterranean well, the fluid having a density which changes over time, the apparatus comprising:

a vortex assembly having a vortex chamber, a vortex outlet, and a first flow inlet and a second flow inlet into the vortex chamber;

a fluid control system having a first fluid passageway and a second passageway, fluid exiting the first and second passageway directed into the vortex assembly; and a movable fluid diverter positioned in the second passageway, the fluid diverter moved by change in the fluid density, the fluid diverter movable to restrict fluid flow through the second passageway in response to change in the fluid density, wherein the movable fluid diverter comprises a floating element unattached to the walls of the passageways.

2. An apparatus as in claim 1, wherein the second passageway is for directing fluid flow as it exits the first fluid passageway.

3. An apparatus as in claim 1, the fluid control system further comprising a third passageway, and a movable fluid diverter positioned in the third passageway.

4. An apparatus as in claim 3, wherein the second and third passageways are for directing fluid flow as it exits the first fluid passageway and into the vortex assembly.

5. An apparatus as in claim 1, the fluid control system further comprising a third passageway, and the movable fluid diverter movable between the first and second passageways.

6. An apparatus as in claim 1, wherein the movable fluid diverter rotates about a longitudinal axis of the fluid diverter.

7. An apparatus as in claim 1, wherein the movable fluid diverter pivots about a radial axis of the fluid diverter.

8. An apparatus as in claim 1, wherein the movable fluid diverter comprises at least one floating ball.

9. An apparatus as in claim 1, wherein the movable fluid diverter is of a preselected effective density and is buoyant in a fluid of a preselected density.

10. An apparatus as in claim 1, wherein the fluid diverter is movable between a first and a second position, and wherein the fluid diverter is biased towards the first position by a biasing member.

11. An apparatus as in claim 6, wherein the fluid diverter rotates to a plurality of rotational angles, and wherein restriction of the fluid flow is related to the rotational angle of the fluid diverter.

12. An apparatus as in claim 1, wherein fluid flow through the first flow inlet results in a substantially spiral flow in the vortex chamber.

13. An apparatus as in claim 12, wherein fluid flow through the second flow inlet results in a substantially radial flow in the vortex chamber.

14. An apparatus as in claim 12, wherein fluid exiting the first fluid passageway is directed into the first flow inlet of the vortex assembly when the movable fluid diverter is of a lower effective density than the fluid.

15. An apparatus as in claim 14, wherein fluid exiting the first fluid passageway is directed into the second flow inlet of the vortex assembly when the movable fluid diverter is of a higher effective density than the fluid.

16. An apparatus as in claim 14, wherein the movable fluid diverter restricts fluid flow through the second passageway when the movable fluid diverter is of a lower effective density than the fluid.

17. An apparatus as in claim 16, wherein the movable fluid diverter restricts fluid flow through the second passageway when the movable fluid diverter is of a higher effective density than the fluid.

18. An apparatus as in claim 1, further comprising a downhole tool for use in a subterranean well, the vortex assembly, fluid control system and movable fluid diverter positioned within the downhole tool.

19. An apparatus as in claim 10, wherein the biasing member is a counterweight.

20. An apparatus as in claim 1, wherein the fluid diverter moves between a first position in which the fluid diverter restricts fluid flow through the second passageway, and a second position in which fluid flow through the second passageway is unrestricted.

21. A method of autonomously controlling fluid flow in a subterranean well, the fluid having a density which changes over time, the method comprising the steps of:

flowing fluid through a primary fluid passageway of a fluid control system;

flowing fluid from the primary fluid passageway into a vortex assembly having a first and second flow inlet into a vortex chamber;

flowing fluid through a control passageway of the fluid control system, the control passageway for controlling fluid flow as it exits the primary fluid passageway and into the inlets of the vortex chamber; and moving a movable fluid diverter positioned in the control passageway in response to a change in the fluid density, the fluid diverter movable to restrict fluid flow through the control passageway, wherein the movable fluid diverter comprises a floating element unattached to the walls of the passageways.

* * * * *